US009492036B2

(12) United States Patent
Opwald et al.

(10) Patent No.: US 9,492,036 B2
(45) Date of Patent: Nov. 15, 2016

(54) SHOWER RECESS, TAP, AND METHOD OF CONSTRUCTION

(71) Applicant: DUPLX PTY LTD, Caulfield North (AU)

(72) Inventors: Colin Opwald, Caulfield North (AU); Lee Andrew Baker, Preston (AU)

(73) Assignee: DUPLX PTY LTD, Caulfield North, Victoria (AU)

( * ) Notice: Subject to any disclaimer, the term of this patent is extended or adjusted under 35 U.S.C. 154(b) by 0 days.

(21) Appl. No.: 14/783,874

(22) PCT Filed: Apr. 11, 2014

(86) PCT No.: PCT/AU2014/000395

§ 371 (c)(1),
(2) Date: Oct. 12, 2015

(87) PCT Pub. No.: WO2014/165920

PCT Pub. Date: Oct. 16, 2014

(65) Prior Publication Data

US 2016/0066752 A1 Mar. 10, 2016

(30) Foreign Application Priority Data

Apr. 12, 2013 (AU) ..... 2013204303
Mar. 17, 2014 (AU) ..... 2014900919

(51) Int. Cl.

| | |
|---|---|
| ***A47K 3/00*** | (2006.01) |
| ***A47K 3/28*** | (2006.01) |
| ***E03C 1/04*** | (2006.01) |
| ***E03C 1/05*** | (2006.01) |
| ***A47K 3/30*** | (2006.01) |
| ***E03C 1/06*** | (2006.01) |

(52) U.S. Cl.
CPC ..... *A47K 3/283* (2013.01); *A47K 3/30* (2013.01); *E03C 1/0408* (2013.01); *E03C 1/0412* (2013.01); *E03C 1/05* (2013.01); *E03C 1/06* (2013.01)

(58) Field of Classification Search
CPC ..... A47K 3/28
USPC ..... 4/596–614
See application file for complete search history.

(56) References Cited

U.S. PATENT DOCUMENTS 5,070,549 A 12/1991 Campe

FOREIGN PATENT DOCUMENTS

EP 0348653 A1 1/1990

OTHER PUBLICATIONS

Australian Patent Office, International Search Report on PCT/AU2014/000395, Jun. 4, 2014, PO Box 200, Woden Act 2606, Australia.

*Primary Examiner* — Lori Baker
(74) *Attorney, Agent, or Firm* — Louis Ventre, Jr.

(57) ABSTRACT

The invention provides a shower recess comprising: a shower outlet (3) for showering a person; a partition (2) attached at least to a wall (4) for keeping water within the shower recess; a shower tap (6) installed on the wall (4) for regulating at least the flow of water through the shower outlet; wherein the shower tap (6) is positioned substantially in line with the partition (2) and within an opening in the partition shaped to accommodate the shower tap (6), and the shower tap (6) comprises a handle (20*b*) on the shower recess side of the partition for operation when the person is inside the recess and a handle (20*a*) on the outer side of the partition for operation when the person is outside the recess.

13 Claims, 3 Drawing Sheets

SHOWER RECESS, TAP, AND METHOD OF CONSTRUCTION

FIELD

The present invention relates to shower recesses, in particular to a shower recess, shower tap and method of constructing a shower recess.

BACKGROUND

It is a well-known problem in the design of many shower recesses that the taps for controlling water flow are accessible only by reaching through an area where the water will impinge on the skin, and it can become impossible to adjust the water temperature after the taps are turned on without suffering scalding or discomfort.

There is a need to provide an improved shower recess which does not suffer from this problem, and yet it is economical to manufacture and install and simple in construction.

SUMMARY OF THE INVENTION

In accordance with a first broad aspect of the invention, there is provided a shower recess comprising:

a shower outlet for showering a person;

a partition attached at least to a wall for keeping water within the shower recess;

a shower tap installed on the wall for regulating at least the flow of water through the shower outlet;

wherein the shower tap is positioned substantially in line with the partition and within an opening in the partition shaped to accommodate the shower tap, and the shower tap comprises a handle on the shower recess side of the partition for operation when the person is inside the recess and a handle on the outer side of the partition for operation when the person is outside the recess.

In one embodiment, the shower tap is a mixer tap comprising a replaceable mixer tap cartridge operated through a spigot adapted to move in two directions to provide control over both flow and mixture of water, with each handle mechanically interconnected to the spigot so as to actuate movement in both directions. The mixer tap and mixer tap cartridge may be arranged so that rotation of the spigot about a horizontal axis substantially in line with the partition provides control over mixture and tilting of the spigot provides control over flow. The handles and mixer tap cartridge may be positioned and connected so that a substantially horizontal position of each handle of the horizontal axis movement corresponds to a midway position of mixture, and movement of each handle towards or away from the wall controls flow. The mixer tap cartridge may be oriented so that the spigot tilts about an axis which at the midway position of mixture is substantially vertical.

In one embodiment, the shower tap comprises a handle-to-spigot adapter shaped and sized at an end face thereof to be secured over the spigot and with handle receiving screw holes on mutually opposite sides of the adapter for receiving each handle.

In one embodiment, the shower tap comprises a tap frame adapted to be secured to a plumbing wall fixture and to extend into the partition opening and having a frame border shaped and sized to receive an edge of the partition bordering on the opening.

In one embodiment, the shower tap comprises a rotating part having handle receiving slots on opposed sides thereof, the rotating part being arranged so as to rotate when the handles are rotated about a horizontal axis and the slots being arranged to allow movement of the handles towards or away from the wall.

In one embodiment, the shower tap comprises shower recess side and outer side covers shaped and sized so as to attached to the frame and secure the rotating part and cover in the opening.

In one embodiment, the opening and tap frame has sufficient space such that the rotating part can be removed to allow removal and replacement of the mixer cartridge once the handles are screwed out and the covers are removed.

In one embodiment, the partition is a glass partition. In one embodiment, the glass partition is fixed to the wall by a metal strip.

In accordance with a second broad aspect of the invention, there is provided a shower tap as described in the first broad aspect of the invention and embodiments there described.

In accordance with a third broad aspect of the invention, there is provided a method of providing the shower recess of the first broad aspect of the invention, the method comprising the steps of:

providing and installing the shower outlet;

providing and installing the shower tap in said position; and providing and installing the partition.

DETAILED DESCRIPTION OF EMBODIMENTS

An embodiment of the current invention will now be described.

Figure 1:
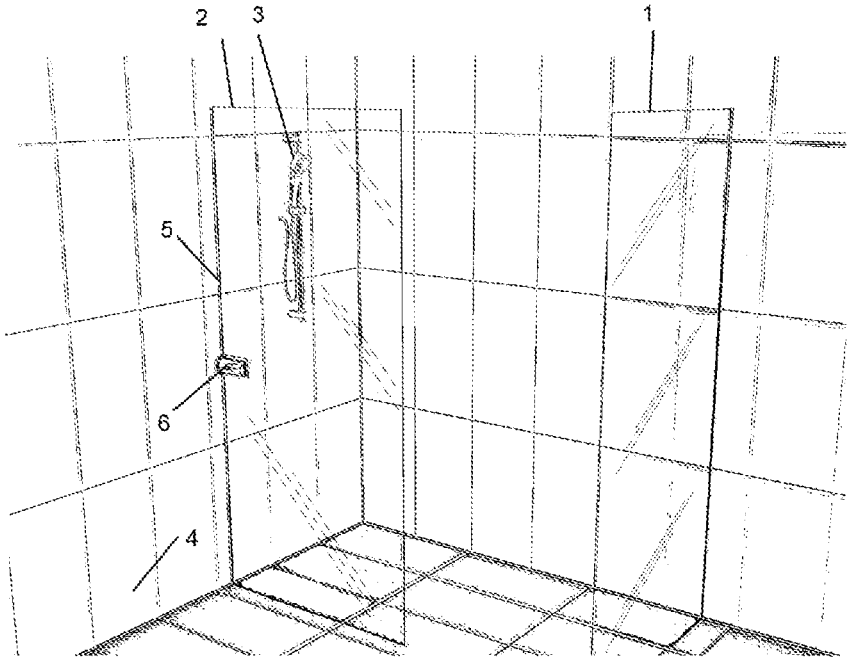
FIG. 1 is a depiction of a shower recess in accordance with an embodiment of the invention.

Referring first to FIG. 1, the shower recess of this embodiment is installed in a corner of a tiled bathroom, with fixed glass partitions 1 and 2 protecting the rest of bathroom from splashes, and a shower rose attachment 3 positioned on wall 4 inside the shower recess with pipes and plumbing hidden behind the wall 4, as is conventionally known in the art. A shower tap 6 is positioned not wholly inside the shower recess as is standard, but is positioned on wall 4 substantially in line with glass partition 2, and has two control handles, one accessible from the shower recess side of the partition 2 and the other handle accessible from the outer side of the partition 2.

Figure 2:
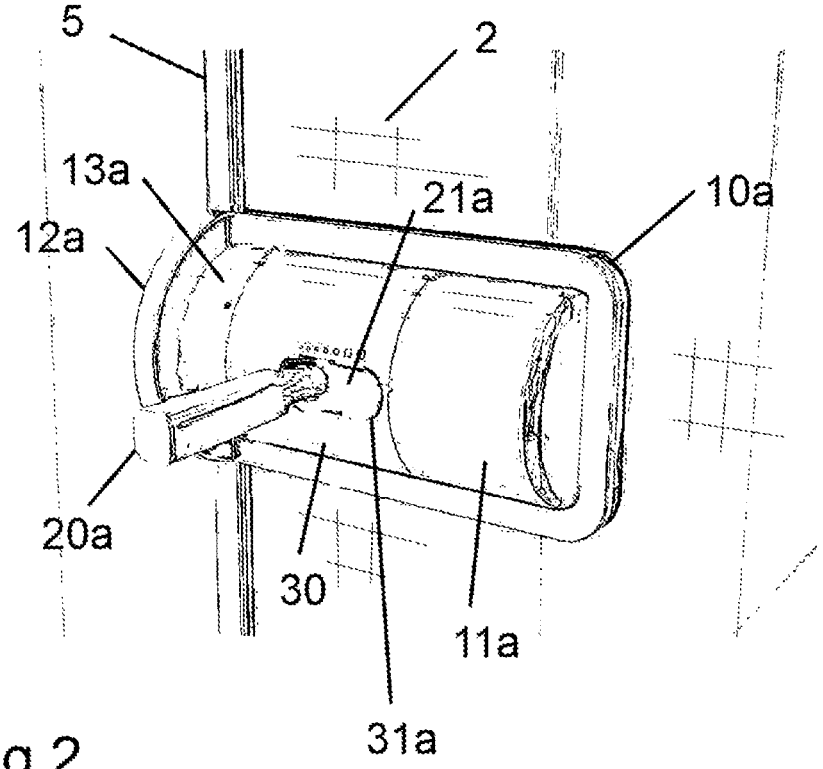
FIG. 2 is a close-up view of an installed shower tap of the shower recess of FIG. 1.

Referring now to FIG. 2, a close-up view of the installed shower tap 6 from the outer side of partition 2 is provided. Glass partition 2 is fixed to the wall 4 by metal securing strip 5 above and below the tap and has a suitably sized and positioned opening cut during manufacture or on-site to accommodate the tap. Visible when installed is a first outer cover integral with border 10*a*, outer cover portions 12*a*, 13*a* and 11*a*, accommodating outer rotating part 30 in the general shape of a cylinder. Rotating part 30 comprises a slot 31*a* and plastic cover 21*a* slides behind the slot under lateral movement of handle 20*a* which projects through a hole in the slot into an internal mechanical interconnection to be described below. A corresponding second outer cover 10*b*, handle 20*b* etc is provided on the shower recess side of partition 2 and is not visible in this FIG. 2.

Figure 3:
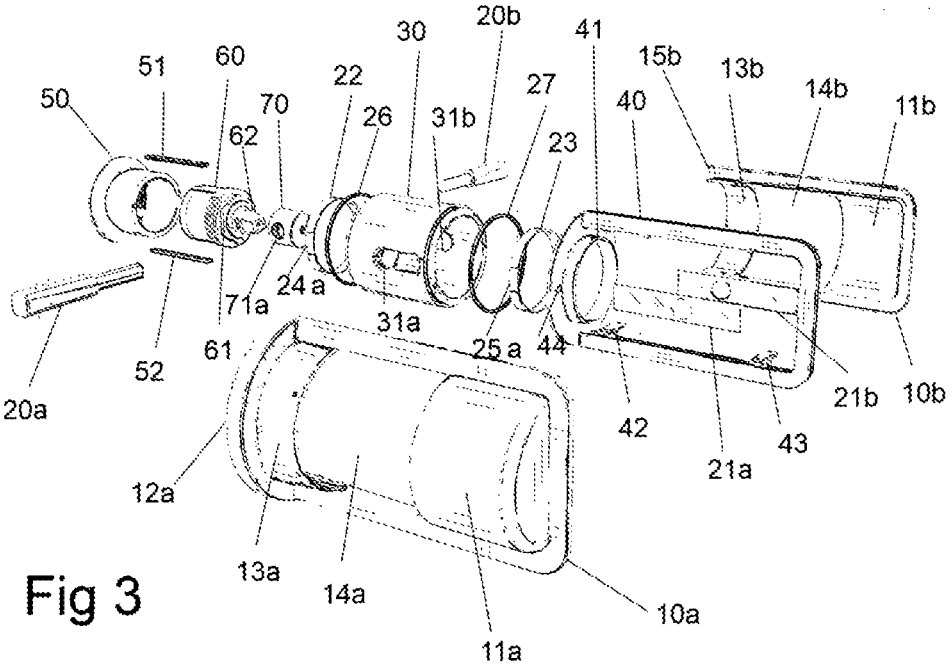
FIG. 3 is an exploded view of the shower tap of FIG. 2 showing the component parts.

Referring now to FIG. 3, an exploded view of components of shower tap 6 is shown. A base point of fixture for tap 6 is a plumbing wall fixture in the form of "breech" and cartridge housing 50, which contains within terminations of hot and cold pipes with O-ring seals for engagement and sealing with mixer cartridge 60, and a mixed water outlet connected to a pipe leading to shower rose 3. The breech and cartridge housing 50 is positioned by the plumber along a planned line of attachment of the glass partition 2, the attachment of the partition 2 being provided by metal attachment strip 5 shown in FIG. 2. The breech and housing 50 is similar to those known in the art, except that the terminations of pipes and correspondingly the mixer cartridge 60 are rotated through 90° from the normal orientation so as to accommodate a standard mixer cartridge 60 with spigot 62 that is normally used in a conventional shower tap. A conventional shower tap is normally installed so that a tilting axis of the spigot 62 is horizontal when the spigot is rotated to a midpoint of the mixing control, allowing for tap handles with a lifting movement to actuate the flow control. In application to the invention, by contrast, the standard mixer cartridge is in the above-mentioned 90 degree rotated orientation so that the two handles 20*a* and 20*b* are substantially horizontal when the spigot 62 is rotated to the midpoint of the mixing control, and a left-right movement of the handles actuates the flow control. Handles 20*a* and 20*b* are mechanically connected to spigot 62 via handle-to-spigot adapter 70 which comprises mutually opposite screw holes 71*a* and 71*b* (71*b* not shown).

Fixed to breech and mixer housing 50, by screws through screw holes such as 44, is a frame which extends to the opening cut into the partition 2 and comprises a frame border 40 shaped and sized to receive an edge of the partition bordering on the opening. Outer cover borders 10*a* and 10*b* are shaped to hook over the frame 40 at a top edge and attach via grub screws from below into grub screw receiving plates 42 and 43 on the frame. Sealing strips 51 and 52 are secured on an inside edge of frame border 40 so as to engage outer rotating part 30 at a top and bottom thereof when installed in the gap 14*a,b* defined in the cover. Sealing strips 51 and 52 help to provide resistance to water leakage from the shower recess side, as do O-ring seals 26 and 27. Sliding slot cover securing rings 22 and 23 are provided to be inserted inside outer rotating part 30 so as to hold sliding slot covers 21*a* and 21*b* in position at either end thereof while allowing sliding through recesses 24*a,b* and 25*a,b*.

Assembly of the relevant parts of the shower recess proceeds is as follows. First, plumbing wall fixture 50 is installed with associated pipework behind wall 4, and the frame is fitted thereon with screws through screw holes such as 44. Glass partition 2 with appropriately sized opening can now be positioned and received at an edge of the opening into the frame border 40. It will be appreciated that frame border 40 can be designed to be very wide so as to allow substantial mismatch between the opening cut into the glass partition 2 and the tap. Mixer cartridge 60 is now inserted into the breech and cartridge housing 50 and secured by screwing in mixer cartridge securing ring 61, causing engagement with O-ring seals of the water pipe terminations at the back of the breech and cartridge housing 50. Handle-to-spigot adapter 70 is now secured on to spigot 62 of mixer cartridge 60 with a grub screw. Outer rotating part 30 is assembled with O-ring seals 26 and 27, sliding slot covers 21*a* and 21*b*, and sliding slot cover securing rings 22 and 23. Upper and lower sealing strips 51 and 52 already being positioned on the inner edges of the frame border 40, the outer rotating part assembly is able to be manoeuvred into the opening over adapter 70 and housing 50. The first and second outer covers can now be positioned over the frame border 40 and encompassing rotating part 30 in the gaps 14*a,b*, securing rotating part 30 in place within the gaps 14*a,b* by engaging with tracks at either end of rotating part 30. The first and second outer covers are secured with two grub screws each into grub screw receiving plates 42 and 43. The first and second outer covers also have further grub screw holes (not shown), which are left empty on the shower recess side to allow drainage of any internal water back into the shower recess and which are installed with grub screws on the outer side to prevent water leakage on that side. Finally, handles 20*a* and 20*b* are screwed into handle receiving screw holes 71*a* and 71*b*. Disassembly is the reverse process. As will be appreciated, one advantage of this embodiment is that the tap can be disassembled and be mixer cartridge can be changed without disturbing the glass partition 2.

In use, either handle 20*a* operated from outside the shower recess, or handle 20*b* operated from within the shower recess, may be rotated about a horizontal axis to control mixing, and may be moved in an orthogonal direction towards or away from the wall to control water flow. The operation of this embodiment is particularly intuitive because from both outside the recess and inside the recess, water flow is turned on by a movement to the right of the respective handle.

Persons skilled in the art will also appreciate that many variations may be made to the invention without departing from the scope of the invention, which is determined from the broadest scope and claims.

For example, while the embodiment shown relates to mixer taps, in its broadest aspect the invention extends to embodiments which have separate hot and cold controls, which may be housed in a single tap assembly within one opening in the partition, or alternatively may be housed in completely separate taps within separate vertically separated openings in the partition. In the simplest of such embodiments, the operation of each handle of the hot or cold tap will be rotation about a horizontal axis perpendicular to the wall to control the flow.

Further, while the embodiment shown relates to glass partitions, partitions constructed from other materials or more substantial walls are within the broadest scope of the invention.

Further, while the embodiment shown provides a particular mechanical interconnection which is an elegant and slight adaptation of conventional mixer shower tap operation, more complicated mechanical interconnections that provide different directions of movement are within the broadest scope of the invention.

Further still, as discussed above while the embodiment shown comprises a relatively thin frame border, broader frame borders and associated covers are within the scope of the invention that will allow different cover shapes, such as a half-circle, as may be attractive and as may accommodate different shaped openings.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention. Further, any method steps recited in the claims are not necessarily intended to be performed temporally in the sequence written, or to be performed without pause once started, unless the context requires it.

It is to be understood that, if any prior art publication is referred to herein, such reference does not constitute an admission that the publication forms a part of the common general knowledge in the art, in Australia or any other country.

The invention claimed is:

1. A shower recess comprising:

a shower outlet for showering a person;

a shower tap installed on a plumbing fixture in a wall for regulating at least a flow of water from the shower outlet;

a partition comprising a solid panel, the solid panel attached at an angle to the wall;

the partition defining a shower recess side where the shower outlet is located, and an outside of the shower recess;

the partition configured to keep water from the shower outlet on the shower recess side of the partition;

the partition defining an opening in the solid panel, the opening extending to the wall and sized to fit around the shower tap;

wherein the shower tap is positioned substantially in line with a plane of the solid panel and within the opening; and the shower tap comprises two handles, the two handles each operable to control the flow of water from the shower outlet, the two handles consisting of:

a first handle on the shower recess side of the partition, the first handle configured for operation by the person when the person is on the shower recess side of the partition; and a second handle on the outside of the shower recess, the second handle configured for operation by the person when the person is on the outside of the shower recess.

2. The shower recess of claim 1, wherein the shower tap is a mixer tap comprising a replaceable mixer tap cartridge operated through a spigot adapted to move in two directions to provide control over both flow and mixture of water, with the first handle and the second handle mechanically interconnected to the spigot so as to actuate movement in both directions.

3. The shower recess of claim 2, wherein the mixer tap and mixer tap cartridge are arranged so that rotation of the spigot about a horizontal axis substantially in line with the partition provides control over mixture and tilting of the spigot provides control over flow.

4. The shower recess of claim 3, wherein the first handle, the second handle and mixer tap cartridge are positioned and connected so that a substantially horizontal position of the first handle and the second handle corresponds to a midway position of mixture.

5. The shower recess of claim 4, wherein the first handle, the second handle and mixer tap cartridge are positioned and connected so that movement of the first handle and the second handle towards or away from the wall controls flow.

6. The shower recess of claim 5, wherein the mixer tap cartridge is oriented so that the spigot tilts about an axis which at the midway position of mixture is substantially vertical.

7. The shower recess of claim 6, wherein the shower tap comprises a handle-to-spigot adapter shaped and sized at an end face thereof to be secured over the spigot and with handle receiving screw holes on mutually opposite sides of the handle-to-spigot adapter for receiving the first handle and the second handle.

8. The shower recess of claim 7, wherein the shower tap comprises a tap frame adapted to be secured to a plumbing wall fixture and to extend into the opening and having a frame border shaped and sized to receive an edge of the partition bordering on the opening.

9. The shower recess of claim 8, wherein the shower tap comprises a rotating part having handle receiving slots on opposed sides thereof, the rotating part being arranged so as to rotate when the first handle and the second handle are rotated about a horizontal axis and the handle receiving slots being arranged to allow movement of the first handle and the second handle towards or away from the wall.

10. The shower recess of claim 9, wherein shower tap comprises shower recess side and outer side covers shaped and sized so as to attach to the tap frame and secure the rotating part and cover in the opening.

11. The shower recess of claim 10, wherein the opening and tap frame has sufficient space such that the rotating part can be removed to allow removal and replacement of the mixer tap cartridge once the first handle and the second handle are screwed out and the shower recess side and outer side covers are removed.

12. The shower recess of claim 1, wherein the partition is a glass partition.

13. The shower recess of claim 12, wherein the glass partition is fixed to the wall by a metal strip.

* * * * *